US010484788B1

(12) United States Patent
Kudekar

(10) Patent No.: US 10,484,788 B1
(45) Date of Patent: Nov. 19, 2019

(54) ACOUSTIC TRANSDUCER WITH PASSIVE DIAPHRAGM SPATIALLY INTEGRATED WITH ACTIVE DIAPHRAGM

(71) Applicant: Apple Inc., Cupertino, CA (US)

(72) Inventor: Aneesh R. Kudekar, Campbell, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/146,067

(22) Filed: Sep. 28, 2018

(51) Int. Cl.
*H04R 1/28* (2006.01)
*H04R 9/06* (2006.01)
*H04R 1/02* (2006.01)
*H04R 1/24* (2006.01)

(52) U.S. Cl.
CPC ..... *H04R 1/2834* (2013.01); *H04R 1/02* (2013.01); *H04R 1/24* (2013.01); *H04R 9/06* (2013.01)

(58) Field of Classification Search
CPC ..... H04R 1/2834; H04R 1/24; H04R 1/02; H04R 9/06
USPC ..... 381/345
See application file for complete search history.

(56) References Cited

U.S. PATENT DOCUMENTS 6,704,426 B2 * 3/2004 Croft, III ..... H04R 1/2842 181/144
9,042,582 B2 * 5/2015 Chan ..... H04R 1/021 181/150
9,294,841 B2 * 3/2016 Sahyoun ..... H04R 1/2834
9,571,934 B2 * 2/2017 Stabile ..... H04R 1/2834
9,800,970 B2 * 10/2017 Proni ..... H04R 1/2834
2002/0146145 A1 * 10/2002 James ..... H04R 7/20 381/426
2004/0105565 A1 * 6/2004 Butters ..... H04R 1/2834 381/347
2007/0140522 A1 * 6/2007 Stewart ..... H04R 9/022 381/421
2014/0029782 A1 * 1/2014 Rayner ..... H04R 1/2834 381/386
2014/0185838 A1 7/2014 Chan et al.
2014/0334656 A1 * 11/2014 Lu ..... H04R 1/10 381/370
2014/0355806 A1 * 12/2014 Graff ..... H04R 1/025 381/334
2015/0304760 A1 * 10/2015 Yeh ..... H04R 1/1058 381/370
2017/0013352 A1 * 1/2017 Shihuang ..... H04R 1/283

* cited by examiner

*Primary Examiner* — Oyesola C Ojo
(74) *Attorney, Agent, or Firm* — Ganz Pollard, LLC

(57) ABSTRACT

An acoustic transducer includes a passive diaphragm and an active diaphragm. The active diaphragm electromechanically couples to an electric drive element and the passive diaphragm is configured to acoustically couple with pressure changes induced by excursions of the active diaphragm. The active diaphragm has an outer perimeter and an inner perimeter, with the X-Y (horizontal) points on the outer perimeter of the passive diaphragm coinciding on or within X-Y points on at least the outer perimeter of the active diaphragm over a common, orthogonal Z coordinate so that the passive diaphragm projects a shape that falls on or within an area of the active diaphragm. In some cases, the inner perimeter of the active diaphragm may define a bounded area for the active diaphragm, the passive diaphragm having an outer perimeter that axially, superimpositionally coincides on or within the inner perimeter of the bounded area.

20 Claims, 6 Drawing Sheets

ACOUSTIC TRANSDUCER WITH PASSIVE DIAPHRAGM SPATIALLY INTEGRATED WITH ACTIVE DIAPHRAGM

FIELD

This application and related subject matter (collectively referred to as the "disclosure") generally concern acoustic transducers and related methods and systems, and more particularly, but not exclusively, to electro-acoustic transducers incorporating a passive radiator or diaphragm in combination with an actively driven diaphragm.

BACKGROUND

In general, an acoustic signal constitutes a vibration that propagates through a carrier medium, such as, for example, a gas, a liquid, or a solid. An acoustic transducer, in turn, is a device configured to convert an incoming acoustic signal to another form of signal (e.g., an electrical signal), or vice-versa. Thus, an electro-acoustic transducer in the form of a loudspeaker can convert an incoming signal (e.g., an electro-magnetic signal) to an emitted acoustic signal, while an acoustic transducer in the form of a microphone can be configured to convert an incoming acoustic signal to another form (e.g., an electro-magnetic signal).

Electronic devices can include one or more electro-acoustic transducers to emit sound. Given size constraints, some electronic devices incorporate electro-acoustic transducers configured as so-called "micro-speakers." Examples of micro-speakers include a loudspeaker transducer found within an earphone, a headphone, a smart-phone, or other similar compact electronic device, such as, for example, a wearable electronic device, a portable time-piece, or a tablet-, notebook-, or laptop-computer. Micro-speakers operate on principles similar, but not necessarily identical, to larger electro-acoustic transducers.

Many commercially available electronic devices have a characteristic length scale smaller than a characteristic length scale of conventional acoustic chambers and acoustic radiators. Consequently, many electronic devices do not incorporate conventional acoustic radiators and acoustic chambers, given their incompatible size differences. As a further consequence, some electronic devices do not provide an audio experience to users on par with that provided by more conventional, albeit larger, loudspeakers.

SUMMARY

Subject matter disclosed herein overcomes many problems in the prior art and address one or more of the aforementioned or other needs. In some respects, this disclosure generally concerns acoustic transducers wherein a passive diaphragm is spatially integrated with an active diaphragm in a compact form, without substantially compromising acoustical attributes. Related methods and systems also are disclosed.

Some configurations of disclosed acoustic transducers combine or integrate attributes and structure conventionally found distributed between or among separate system components or modules. Such configurations can eliminate one or more conventional components while retaining one or more functions conventionally provided by the eliminated component, providing certain advantages, including a more compact arrangement of the parts. Examples of acoustic transducers include loudspeaker transducers, and microphone transducers.

Notably, disclosed acoustic transducers contrast starkly with the acoustic transducers incorporated in previous acoustic modules. Those previous acoustic modules incorporated an acoustic transducer wherein the active transducer 12 is separate from the passive radiator 13, as seen in FIG. 1A, for example. Consequently, disclosed acoustic transducers eliminate the need for a separated passive radiator, while retaining the passive radiator (diaphragm) function and acoustical capability of prior acoustic transducers. The acoustic diaphragms, as described herein, can allow disclosed acoustic transducers, and modules incorporating them, to substantially meet or exceed acoustic targets in area- or volume-constrained applications, while passive radiator capabilities previously only attainable by way of acoustic modules having a separated active diaphragm and passive diaphragm in a relatively larger volume.

According to one aspect, an acoustic transducer includes: a chassis and an active diaphragm electromechanically coupled to an electric drive element and suspended from the chassis such that the active diaphragm can reciprocate along an axis of excursion. The chassis also includes a passive diaphragm suspended from the chassis independently of the active diaphragm such that the passive diaphragm is configured to acoustically couple with pressure changes induced by excursions of the active diaphragm. The active diaphragm defines an outer perimeter and an inner perimeter, and the passive diaphragm defines an outer perimeter, wherein a projection of at least a portion of the outer perimeter of the passive diaphragm on a plane oriented orthogonally relative to the axis of excursion coincides with or is positioned within at least a region of a projection of the outer perimeter of the active diaphragm on the plane.

In the foregoing and other embodiments, the inner perimeter of the active diaphragm may define a bounded area for the active diaphragm, and the passive diaphragm has an outer perimeter that axially, superimpositionally coincides on or within the inner perimeter of the bounded area.

In the foregoing and other embodiments, the bounded area may be a fully bounded area comprising an aperture in the active diaphragm.

In the foregoing and other embodiments, the passive diaphragm may be co-planar with the active diaphragm.

In the foregoing and other embodiments, the passive diaphragm may be axially offset from the active diaphragm.

In the foregoing and other embodiments, the passive diaphragm may be axially offset from the active diaphragm by not more than the peak-to-peak excursion of the passive diaphragm or the zero-to-peak excursion of the passive diaphragm during intended use.

In the foregoing and other embodiments, the passive diaphragm may be configured to acoustically couple with the active diaphragm at a frequency range of about 100 Hz to about 400 Hz.

In the foregoing and other embodiments, a voice coil may be coupled with the active diaphragm, such that the active diaphragm and the coil are movable in correspondence with each other.

In the foregoing and other embodiments, a magnet may be so positioned adjacent the voice coil as to cause a magnetic field of the magnet to interact with a magnetic flux corresponding to an electrical current through the voice coil.

In the foregoing and other embodiments, the magnet may include an inner magnet and an outer magnet, wherein the voice coil is positioned between the inner magnet and the outer magnet and configured to move pistonically to and fro between a distal-most position and a proximal-most position relative to the inner magnet.

In the foregoing and other embodiments, the inner magnet may include an opening and the passive diaphragm may be disposed over the opening.

According to another aspect, an acoustic-transducer module includes an acoustic transducer having an active diaphragm electromechanically coupled to an electric drive element, and a passive diaphragm that is not coupled electromechanically to an electrodynamic driver. In other words, it is electromechanically independent of the electric drive element. The passive diaphragm is configured to acoustically couple with pressure changes induced by the active diaphragm. In other words, it is configured to be driven through reciprocating excursions by pressure changes induced by movement of the active diaphragm. The active diaphragm has an outer perimeter and an inner perimeter. The inner perimeter defines an aperture in the active diaphragm. The passive diaphragm has an outer perimeter that, at least in part, axially, superimpositionally coincides on or within the inner perimeter of the active diaphragm. The acoustic-transducer is movably mounted to a chassis.

In the foregoing and other embodiments, the active diaphragm may have a ring-like configuration. The passive diaphragm is concentrically disposed within the ring, with the outer perimeter of the passive diaphragm having its outer perimeter disposed adjacent the inner perimeter of the active diaphragm. The passive diaphragm is independent of the active diaphragm's drive element and is not mechanically, movably coupled to the active diaphragm.

In the foregoing and other embodiments, the active diaphragm may have an elliptical configuration, and the passive diaphragm may have an outer perimeter with a concentrically matching configuration.

In the foregoing and other embodiments, the module may be disposed in a housing, e.g., a housing for a speaker or microphone.

According to yet another aspect, a method of making an acoustic-transducer includes providing an active diaphragm electromechanically coupled to an electric drive element; and providing a passive diaphragm, which is not coupled electromechanically to an electrodynamic driver. The passive diaphragm is configured to acoustically couple with pressure changes induced by the active diaphragm. The active diaphragm may have an outer perimeter and an inner perimeter, the X-Y (horizontal) points on the outer perimeter of the passive diaphragm coinciding on or within X-Y points on at least the outer perimeter of the active diaphragm over a common, orthogonal Z coordinate so that the passive diaphragm projects a shape that falls on or within an area of the active diaphragm.

The foregoing and other features and advantages will become more apparent from the following detailed description, which proceeds with reference to the accompanying drawings.

BRIEF DESCRIPTION OF THE DRAWINGS

Referring to the drawings, wherein like numerals refer to like parts throughout the several views and this specification, aspects of presently disclosed principles are illustrated by way of example, and not by way of limitation.

DETAILED DESCRIPTION

The following describes various principles concerning acoustic transducers, and related methods and systems, by way of reference to specific embodiments. For example, certain aspects of the disclosed subject matter pertain to acoustic transducers that include an active diaphragm with a passive diaphragm that is integrated with the active diaphragm in a spatially compact manner. As used, herein, an "active diaphragm" is one that has an associated electrical drive element, i.e., there is a mechanical coupling of the diaphragm and the drive element. As used herein, a "passive diaphragm" or "passive radiator" is a diaphragm that is not electromechanically coupled to and driven by an electrical drive element. Instead, it is driven by the pressure changes or vibrations induced by the active driver, with the passive driver thereby being acoustically coupled to the active diaphragm.

Acoustic transducers, modules, and systems (and associated techniques) having attributes that are different from those specific examples discussed herein can embody one or more presently disclosed principles and can be used in applications not described herein in detail. Accordingly, such alternative embodiments can also fall within the scope of this disclosure.

I. Overview

In general, disclosed acoustic transducers include an active diaphragm and a spatially integrated passive diaphragm. The active diaphragm is electromechanically coupled to an electric drive element.

In simple terms, a projection of the passive diaphragm on a plane of the active diaphragm defines a shape that falls on or within the plane of the active diaphragm. To elaborate on the spatial relationship, the active diaphragm has an outer perimeter and an inner perimeter, while the passive diaphragm has an outer perimeter. The X-Y (horizontal) points on the outer perimeter of the passive diaphragm coincide on or within X-Y points on at least the outer perimeter of the active diaphragm over a common, orthogonal Z coordinate.

Figure 2:
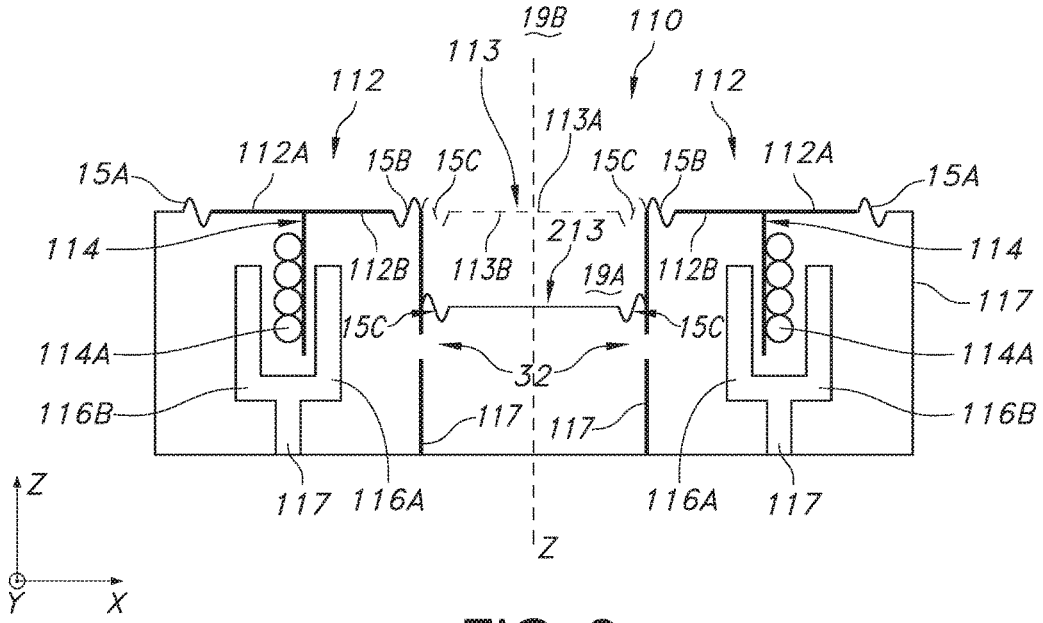
FIG. 2 schematically illustrates a cross-sectional view of an acoustic module incorporating an acoustic transducer with an active diaphragm and a spatially integrated passive diaphragm embodying selected principles disclosed herein.
Figure 3:
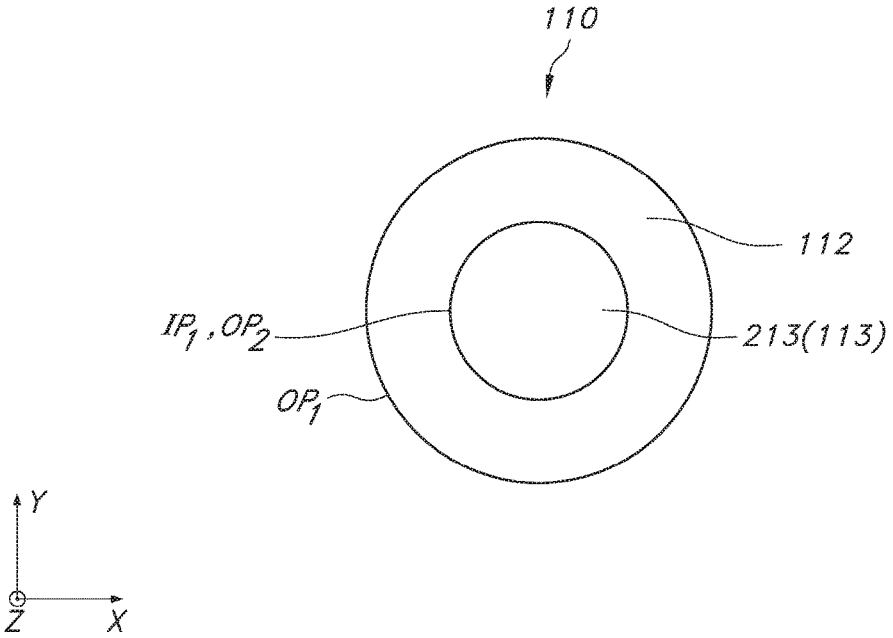
FIG. 3 illustrates a plan view of an acoustic module like the one shown in FIG. 2.

As one of many possible examples, as seen in FIGS. 2-3, the foregoing principles provide for acoustic transducers that include an active diaphragm that has an outer perimeter and an inner perimeter, the inner perimeter defines a bounded area in the active diaphragm. The passive diaphragm has an outer perimeter that superimpositionally coincides on or within the inner perimeter of the active diaphragm. A more detailed description of the innovative acoustic transducers follows a detailing of general features of acoustic transducers.

According to one aspect, discussed in detail below, an acoustic transducer includes: a chassis and an active diaphragm electromechanically coupled to an electric drive element and suspended from the chassis such that the active diaphragm can reciprocate along an axis of excursion. The chassis also includes a passive diaphragm suspended from the chassis independently of the active diaphragm such that the passive diaphragm is configured to acoustically couple with pressure changes induced by excursions of the active diaphragm. The active diaphragm defines an outer perimeter and an inner perimeter, and the passive diaphragm defines an outer perimeter, wherein a projection of at least a portion of the outer perimeter of the passive diaphragm on a plane oriented orthogonally relative to the axis of excursion coincides with or is positioned within at least a region of a projection of the outer perimeter of the active diaphragm on the plane.

II. General Introduction to Electro-Acoustic Transducers

A loudspeaker can emit an acoustic signal in a carrier medium by vibrating or moving an acoustic diaphragm to induce, or otherwise inducing, a pressure variation or other vibration in the carrier medium. For example, an electromagnetic loudspeaker arranged as a direct radiator can induce a time-varying magnetic flux in a coil (e.g., a wire formed of copper clad aluminum wrapped around, for example, a bobbin) by passing a corresponding time-varying current through the coil (sometimes referred to in the art as a "voice coil"). The coil can be positioned adjacent one or more magnets (e.g., a permanent magnet having a fixed, or an electromagnet having a variable, magnetic field). A resultant force as between the magnetic flux emanated from the coil and the magnetic field(s) of the one or more magnets can urge the coil into motion, preferably a pistonic motion in some embodiments.

The coil, in turn, can be directly or indirectly coupled with an acoustic diaphragm configured to induce a pressure variation in a surrounding carrier medium as the diaphragm moves in correspondence with the, e.g., pistonic, movement of the coil. The diaphragm can be rigid, or semi-rigid, and often is light weight to reduce inertial effects and allow the acoustic diaphragm to vibrate or otherwise induce a pressure variation or other vibration in a surrounding or adjacent carrier medium. Typically, the diaphragm is a membrane or thin sheet of material. It can have various shapes, e.g., planar, or multiaxial, such as concave or convex. The diaphragm material is typically supported on its perimetrical edge by a support or frame, with a suspension system intermediate the diaphragm and frame. The diaphragm spans from the edge centrally to a mechanically coupled coil or bobbin. The coil and/or the bobbin can provide a measure of structural stability to the membrane or sheet material, to maintain predominately pistonic movement in the diaphragm.

A suitable diaphragm suspension system generally provides a restoring force to the diaphragm to maintain the coil in a desired position and/or orientation. The suspension allows for controlled axial (e.g., pistonic) motion, while largely preventing lateral motion or tilting that could cause the coil to strike another motor component, or which could otherwise induce distortion or mechanical inefficiency leading to degraded performance of the transducer.

Quality midrange and bass diaphragms may be made of paper, paper composites and laminates, plastic materials such as, for example, polypropylene, or mineral/fiber filled polypropylene. Such materials have high strength/weight ratios. Other materials used for diaphragms include polyetheretherketone (PEEK) polycarbonate (PC), Mylar (PET), silk, glass fiber, carbon fiber, titanium, aluminum, aluminum-magnesium alloy, nickel, tungsten, and beryllium. An ideal behavior for a cone/surround assembly is an extended range of linearity or "pistonic" motion characterized by i) minimal acoustical breakup of the cone material, ii) minimal standing wave patterns in the cone, and iii) linearity of the surrounds force-deflection curve. The cone-stiffness/damping plus the surround's linearity/damping play an important role in accurately reproducing a voice-coil signal waveform as an acoustic signal.

A diaphragm surround may be resin-treated cloth, resin-treated non-wovens, polymeric foams, or thermoplastic elastomers over-molded onto the diaphragm body. An ideal surround has a linear force-deflection curve with sufficient damping to fully absorb vibrational transmissions from the cone/surround interface, and the "toughness" to withstand long-term vibration-induced fatigue. Sometimes the diaphragm and the outer surround are monolithic, e.g., molded in a single or integrated molding process, e.g., co-molding or over-molding processes.

Figure 1A:
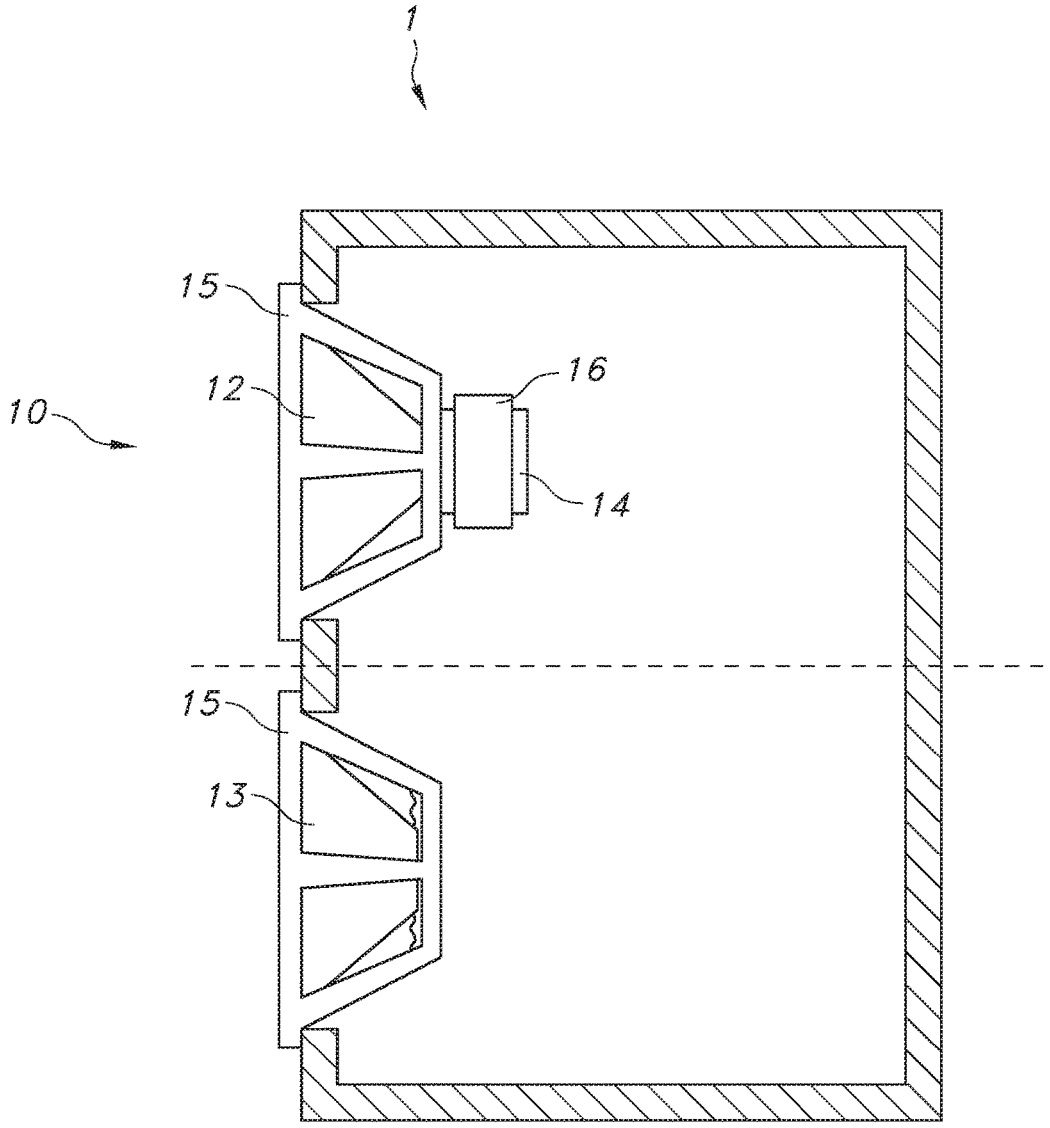
(PRIOR ART) FIG. 1A
FIG. 1A schematically illustrates a cross-sectional view of an acoustic module incorporating an acoustic transducer with an active transducer and a separated passive transducer, which is representative of the prior art.

FIG. 1A shows a representative loudspeaker enclosure 1 having a housing 2 with an electro-acoustic transducer 10 that includes an active diaphragm 12. The enclosure also includes a passive diaphragm 13. The passive diaphragm 13 is spatially and mechanically separated from the active diaphragm 12 in the enclosure 1. The enclosure 1 is a sealed (e.g., as opposed to a ported) enclosure.

A passive radiator system as in FIG. 1 uses air contained within an enclosure to excite a resonance that allows the speaker system to create deep pitches (e.g., basslines) with lower input power. The passive radiator resonates at a frequency determined by its mass in combination with the springiness of the air in the enclosure. The resonance frequency can be tuned to the specific enclosure by varying the mass of the passive radiator (e.g., by adding weight to the passive diaphragm, sometimes also referred to in the art as a "cone"). Internal air pressure variations induced by movements of the active driver cone 12 moves the passive radiator cone 13. This resonance simultaneously reduces the excursion distance through which the woofer has to move to deliver a selected loudness at and around the resonant frequency. The weight of the cone of the passive radiator can be approximately equivalent to a mass of air that would resonate within a waveguide at the selected resonance frequency.

As space becomes more and more constrained in electronic devices, there is less room to have an active transducer of sufficient size while also having a separate passive radiator, as in FIG. 1. Consequently, a space-constrained loudspeaker can have reduced performance compared to a loudspeaker having an active transducer and a passive radiator and fail to meet desired acoustic performance targets.

Figure 1B:
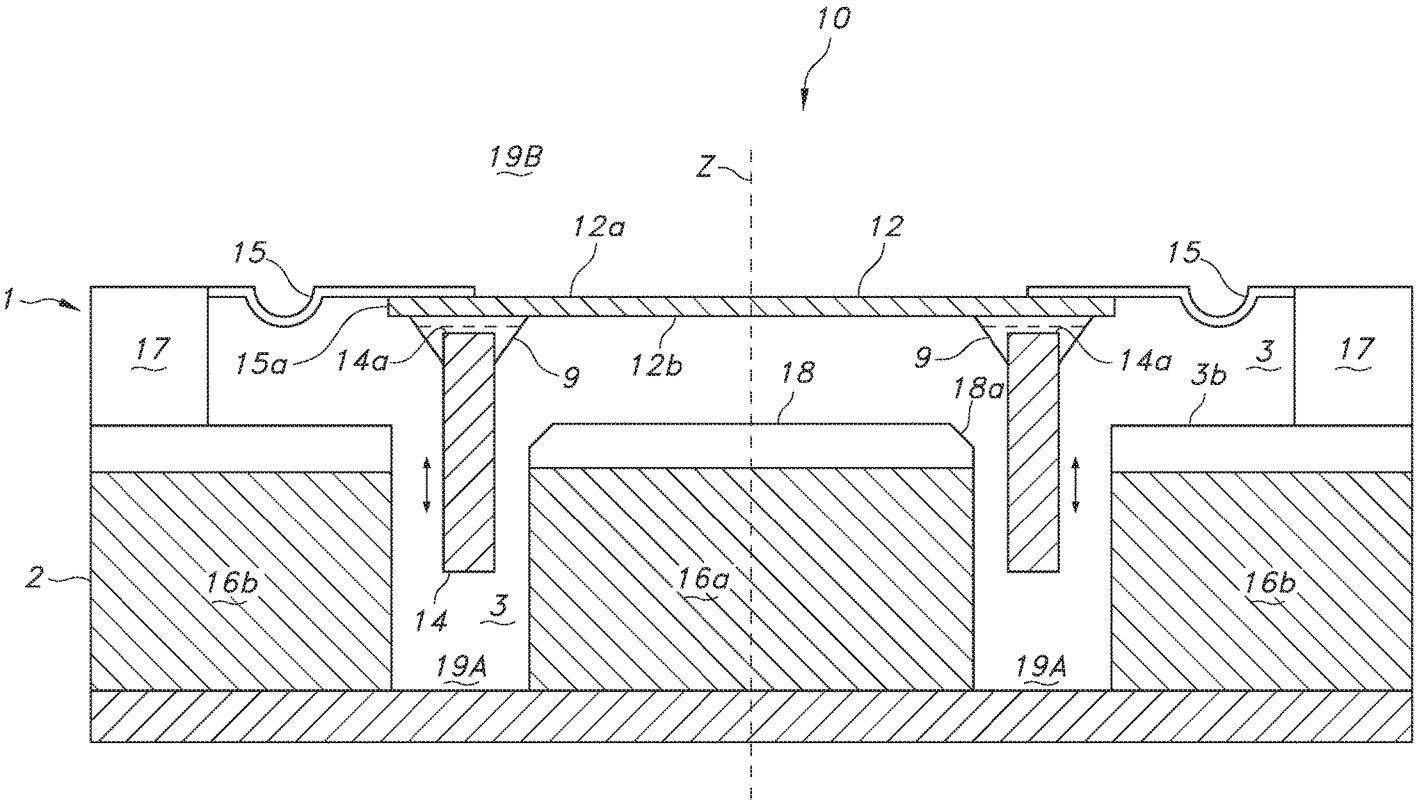
(PRIOR ART) FIG. 1B
FIG. 1B schematically illustrates a cross-sectional view of an active transducer like the one in FIG. 1A.

Referring still to FIGS. 1A-1B, the speaker or housing 2 contains an active diaphragm 12, and a passive diaphragm 13. The active diaphragm 12 is coupled to an electric drive element, (e.g., a voice coil and magnet assembly), and the passive diaphragm 13 is of similar construction but is not attached to a voice coil or wired to an electrical circuit or power amplifier.

The active transducer 10 will be generally discussed, and then modifications will be presented. The same or serial versions (e.g., 12, 112, 212) of the reference numbers used for features denote the same, similar, or analogous features.

Referring to FIG. 1B, an electro-acoustic transducer (also referred to herein as an "active transducer") 10 can have an acoustic radiator (e.g., a diaphragm) 12 physically coupled with an electric drive element 14. The acoustic radiator defines a first major surface 12*a* and an opposed major surface 12*b*, both of which extend into and out of the page, as indicated in FIG. 1B.

The driver element most widely used in speakers to convert the electric current to sound waves is the coil/magnet based dynamic or electrodynamic driver, discussed above. Other forms of drivers include: electrostatic drivers, piezoelectric drivers, planar magnetic drivers, Heil air motion drivers, and ionic drivers, among others.

Referring to the Figures, a coil/magnet base drive element is used as a representative drive element. Drive element 14 can include a bobbin or other member combined with one or more windings of, e.g., an electrically conductive filament. In one aspect, the drive element is formed as a laminated construct, with each layer having a corresponding winding. In another aspect, the drive element does not include a bobbin, but rather is formed from laminated windings of a filament. The drive element 14 can have an annular or an elongated shape to yield a cross-section, as is known in the art. The conductive wire (e.g., copper clad aluminum) is sometimes referred to as a "voice coil wire." Such a bobbin is sometimes referred to in the art as a "voice-coil former" or "former," and the one or more windings is sometimes referred to in the art as a "voice-coil" or "coil."

The voice coil former (or the voice coil, when the former is omitted) can be physically attached, e.g., bonded, to the major surface 12*b* of the acoustic diaphragm 12. For example, a first end of the voice coil 14 can be chemically or otherwise physically bonded to the second major surface 12*b* of the acoustic diaphragm 12. The bond can provide a platform for transmitting mechanical force and mechanical stability to the diaphragm 12. Such mechanical force can be generated by electro-magnetic interactions between a voice coil and a surrounding magnet.

As an example, the drive element 14 can be positioned in a gap between one or more permanent magnets 16*a*, 16*b* (e.g., an NdFeB magnet) such that the member 14 is immersed in a static magnetic field generated by the one or more magnets. An electrical current can pass through the coil and induce a corresponding magnetic field. The induced magnetic field from the coil can interact with the static magnetic field of the magnets 16*a*, 16*b* to urge the coil, and thus the diaphragm 12 to which the drive element 14 is attached, to move.

As the electric current varies in strength and direction, the magnitude of the magnetic forces urging the electrically drive element 14 can vary in magnitude and direction, thus causing the electrically drive element to reciprocate, e.g., as a piston. Such reciprocation is indicated by the double-ended arrows overlying the drive element 14. Further, a physical or mechanical connection 13 between the drive element 14 and the acoustic diaphragm 12 can transmit a reciprocating, pistonic movement of the drive element to the diaphragm. As the respective current or voltage potential alternates, e.g., at an audible frequency, the voice coil 14 (and diaphragm 12) can move, e.g., reciprocate pistonically, and radiate sound.

The transducer module 10 has a frame 17 and a suspension system 15 supportively coupling the acoustic diaphragm 12 with the frame. The diaphragm 12 can be stiff (or rigid) and lightweight. Ideally, the diaphragm 12 exhibits perfectly pistonic motion. The diaphragm, sometimes referred to as a cone or a dome, e.g., in correspondence with its selected shape, may be formed from aluminum, paper, plastic, composites, or other materials that provide high stiffness, low mass, and are suitably formable during manufacture.

The suspension system 15 generally provides a restoring force to the diaphragm 12 following an excursion driven by interactions of the magnetic fields from the driven voice-coil member 14 and the magnet(s) 16*a*, 16*b*. Such a restoring force can return the diaphragm 12 to a neutral position, e.g., as shown in FIG. 1B. The suspension system 15 can maintain the voice coil in a desired range of positions relative to the magnet(s) 16*a*, 16*b*. For example, the suspension 15 can provide for controlled axial motion along an axis of excursion, Z, transverse to the diaphragm 12 (e.g., pistonic motion) while largely preventing lateral motion or tilting that could cause the drive element 14 to strike other motor components, such as, for example, the magnet(s) 16*a*, 16*b* or a member affixed to one of the magnets. As used herein, reference to a "magnet" means a magnet or a magnet assembly. A magnet assembly, in turn, may include a magnet physically coupled with, for example, another member or a coating. For example, a steel plate or other magnetic conductor can be affixed to a magnet to form a magnet assembly.

A measure of resiliency (e.g., a position-dependent stiffness) of the suspension 15 can be chosen to match a force vs. deflection characteristic of the motor system (e.g., the voice coil and magnets 16*a*, 16*b*). The illustrated suspension system 15 includes a surround extending outward of an outer periphery 15*a* of the diaphragm 12. The surround member can be formed from a polyurethane foam material, a silicone material, or other pliant material. In some instances, the surround may be compressed into a desired shape by heat and pressure applied to a material in a mold or die, for example.

A connection 9 between the drive element 14 and the diaphragm 12 may involve attaching an edge 14*a* of the drive element to the second major surface 12*b*, e.g., a flat region defined by the second major surface 12*b*. However, such a bond may be relatively weak, largely due to a relatively small contact area between the edge 14*a* of the drive element and the second major surface 12*b* of the diaphragm. Consequently, fillets 9*a* may be formed to strengthen the connection 9.

However, fillets 9*a* occupy a finite volume apart from the driven element 14 and diaphragm 12, and many commercially desirable electronic devices are quite small. Consequently, other components, e.g., the permanent magnet 16*a*, may be complementarily contoured, as to prevent interference between the fillet 9*a* and the magnet 16*a* during excursions of the diaphragm 12. As shown in FIG. 1B, a top surface 18 of the magnet 16*a* has a chamfer 18*a* contoured in correspondence with the fillet 9*a*, as to prevent interference of the fillet with the magnet 16*a* during a "downward" diaphragm excursion. Forming such a chamfer 18*a* can, in some instances, be accomplished with machining or other processing.

Transducer 10 has a frame (or chassis) 17 and a suspension system including a surround 15 that suspends the respective diaphragm 12 from the chassis 17. For example, the surround 15 can overlap with and be connected with a peripheral region 15*a* of the respective diaphragm 12, 22. Transducer 10 can define a back region 19A bounded in part by the major surface of the diaphragms 12*b*. Similarly, each transducer 10 can emit sound to a surrounding front region 19B partially bounded by first major surface 113A. Some electronic devices acoustically couple such a micro-speaker with one or more open regions suitable for improving radiated sound, as in the nature of an acoustic chamber.

The voice coil 14 can have a cross-sectional shape corresponding to a shape of the major surface of diaphragm 12. For example, the diaphragms can have a substantially circular, rectilinear, ovular, race-track or other shape when viewed in plan from above (or below). Similarly, the voice coil (or voice coil former) can have a substantially circular, rectilinear, ovular, race-track or other cross-sectional shape. In other instances, the cross-sectional shape of the voice coil former can differ from a shape of the diaphragm when viewed in plan from above (or below).

In general, a diameter or major axis of a non-circular micro-speaker diaphragm can measure, for example, between about 3 mm and about 75 mm, such as between about 15 mm and about 65 mm, for example, between about 20 mm and about 50 mm. A minor axis of a non-circular micro-speaker diaphragm can measure, for example, between about 1 mm and about 70 mm, such as between about 3 mm and about 65 mm, for example, between about 10 mm and about 50 mm. A coil for such a micro-speaker can measure between about 0.5 mm and about 3 mm (e.g., between about 1.0 mm and about 1.5 mm) along a longitudinal axis.

An acoustic diaphragm need not be axi-symmetric. For example, some diaphragms have a rectangular or a square periphery, and those of ordinary skill in the art will appreciate that still other shapes of acoustic diaphragm are possible. Similarly, an outer periphery of a passive diaphragm can have a similar or different shape as compared to an outer periphery of the corresponding active diaphragm.

III. Acoustic Transducers Withactive Driver and Spatially Integrated Passive Driver According to one aspect disclosed herein, the passive diaphragm can be superimposed, i.e., projected on a plane of the active diaphragm such that space savings are possible relative to separate active and passive transducers that do not axially superimpose.

The diaphragms 12, 13 in FIG. 1A are not axially superimposed. In that example, no Z coordinate of active diaphragm 12 has a common X-Y coordinate with passive diaphragm 13. Therefore, the passive diaphragm does not lie in a plane of projection on or within the active diaphragm. By coinciding the X-Y (horizontal) points on the outer perimeter of the passive diaphragm on or within X-Y points on at least the outer perimeter of the active diaphragm, over a common, orthogonal Z coordinate, space savings can be achieved.

Another way to describe the relationship of the active and passive diaphragms, is that are aligned such that a projection of the passive diaphragm can put a full or partial shape of the passive diaphragm on or within an area of the active diaphragm when the horizontal (X-Y) surface of the active diaphragm is the horizontal plane onto which the projection of the passive diaphragm falls. One possible, non-limiting, example of this is seen in FIG. 3, discussed in more detail. In this example, passive diaphragm 113 can be seen superimposed within the outer perimeter of active diaphragm 112.

FIGS. 2-3 show one possible example of such an acoustic transducer 110 wherein the active and passive diaphragms 112, 113/213 have such a relation. The active diaphragm 112 has an outer perimeter OP1 and an inner perimeter IP, the inner perimeter defining a bounded area in the active diaphragm. The passive diaphragm 213 or 113, which is an alternative arrangement, has an outer perimeter OP2 that superimpositionally coincides on or within the inner perimeter of the active diaphragm, or within a portion of the bounded area. In this example, the flat circular passive diaphragm 113 or 213 is concentrically disposed in the flat, circular inner perimeter of the active diaphragm 112. In other words, the X-Y coordinates of the passive diaphragm's outer perimeter match or coincide with the active diaphragm's inner perimeter when Z is zero (i.e., the diaphragms are coplanar), when counting the interconnecting surround 15 in FIG. 2. (FIG. 3 is a schematic view of the transducer of FIG. 2, which omits certain details like surround 15.) Although flat diaphragms are shown in an X-Y plane, one or both diaphragms could also project axially in a Z plane. For example, any diaphragm could have a cone shape (e.g., FIG. 5) or other known shapes.

Referring to the example of FIG. 3, if the X-Y coordinates of the outer perimeter OP2 of the passive radiator lie on or within the boundary defined by X-Y coordinates of the inner perimeter IP of the active driver, the passive diaphragm can be superimposed on or within such boundary. In other words, the coordinates superimpositionally coincide with or within the boundary in the same plane, or in axially offset planes. While this example discloses an embodiment where the outer perimeter of the passive diaphragm is concentric to the inner perimeter IP of the active diaphragm, as indicated in the broader description above and elsewhere, significant advantages may also be achieved by superimpositionally arranging the passive diaphragm fully or partially on or within the outer perimeter OP1 of an active diaphragm.

Figure 4:
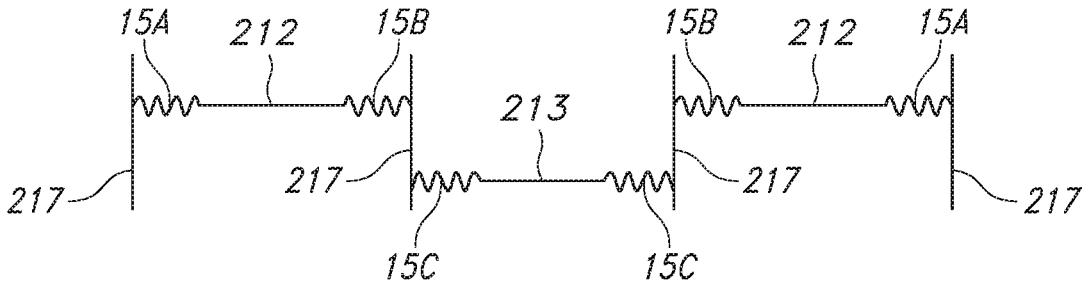
FIG. 4 schematically illustrates a cross-sectional view of an arrangement of a selected embodiment of an active diaphragm and a spatially integrated passive diaphragm embodying selected principles disclosed herein.

From the foregoing, it can be understood that the passive radiator can be fully or partially superimposed over the active diaphragm in a plane projection. Further, the active and passive diaphragms can be arranged fully coplanar, passive diaphragm 113 (FIG. 2) or axially offset, as schematically seen in the arrangement of active diaphragm 212 and passive diaphragm 213 on frame assembly 217, FIGS. 2 and 4. In these examples, the passive diaphragm is downwardly disposed along the axis of excursion Z relative to the active diaphragm. The active diaphragm is coupled to surrounds 15A and 15B. By disposing passive diaphragm 113 or 213 on its own surround 15C, it is mechanically independent of surrounds 15A and 15B and thereby the active diaphragm's electromechanical drive element (not shown) does not drive the passive diaphragm.

During intended use, the excursion distance of the passive diaphragm along the Z-axis of may differ from that of the active diaphragm 112. When designing a system, it is desirable to prevent the passive radiator from interfering with (e.g., striking) a cover plate, grill, or other structure overlying the transducer. To provide for compactness of design without impeding operation of the passive diaphragm, the passive diaphragm may be downwardly, axially offset from the active diaphragm under static conditions. For example, a volume displaced by the passive diaphragm (e.g., diaphragm area multiplied by excursion distance) is proportional to volume displaced by the active diaphragm (e.g., diaphragm area multiplied by excursion distance), though specific proportionality constants may vary with frequency. At system resonance frequency (low frequencies), the passive diaphragm's volume displacement is more. Above resonance, in high frequencies, the passive diaphragm does not travel much, and the active driver dominates in high frequencies. Accordingly, axial offsets may be determined factoring in expected excursion under intended conditions of use, e.g, at resonance.

Figure 5:
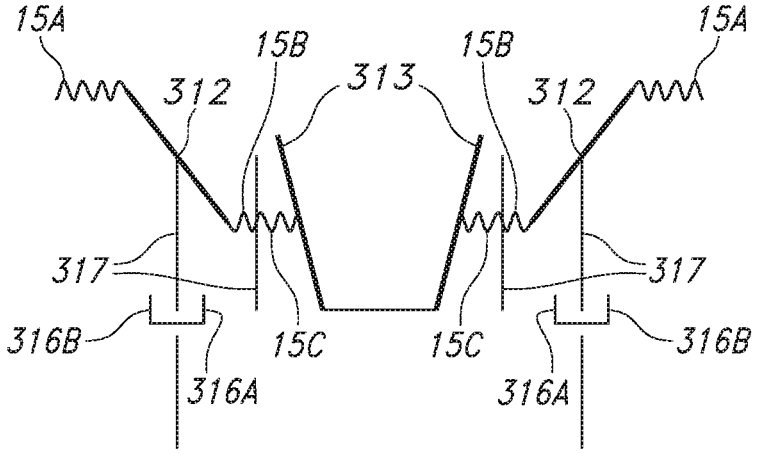
FIG. 5 schematically illustrates a cross-sectional view of an arrangement of another alternative embodiment of an active diaphragm and a spatially integrated passive diaphragm embodying selected principles disclosed herein.

In other aspects, the active and passive diaphragms can be partially coplanar and partially axially offset, as schematically seen in the arrangement of cone-shaped active diaphragm 312 and cone-shaped passive diaphragm 313, FIG. 5. Active diaphragm 312 and passive diaphragm 313 are disposed on frame assembly 317. The active diaphragm is coupled to surrounds 15A and 15B. By disposing passive diaphragm 313 on its own surround 15C, it is mechanically independent of surrounds 15A and 15B, and thereby the active diaphragm's electromechanical drive element (partially shown as magnets 316A, 316B) does not drive the passive diaphragm.

In keeping with the objective of compact design, in other embodiments, for a given horizontal plane (X-Y coordinates), the passive diaphragm is not axially offset from the active diaphragm by more than the peak-to-peak excursion of the passive diaphragm or the zero-to-peak excursion of the passive diaphragm during intended use.

In some embodiments, the active diaphragm has a bounded area that can receive the passive diaphragm, in whole or part. As seen or indicated in FIGS. 3-5, the active diaphragm 112, 212, 312 has an aperture that fully bounds the passive diameter in a given orthogonal plane. Although the aperture may be circular, it can have any other desired closed-loop shape, including oval, polygonal, irregular closed loop, etc.

Figure 6:
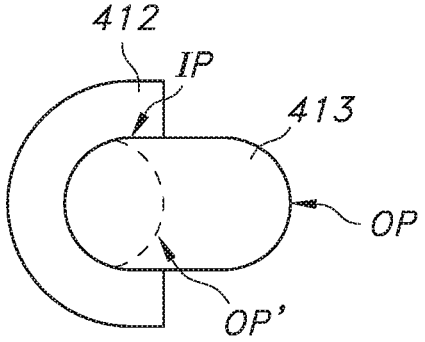
FIG. 6 schematically illustrates a cross-sectional view of an arrangement of another alternative embodiment of an active diaphragm and a spatially integrated passive diaphragm embodying selected principles disclosed herein.

In other embodiments, the passive diaphragm can be partially bounded by the active diaphragm. For example, the active diaphragm can have an open side that receives at least a portion of the passive radiator, as schematically seen in the arrangement of active diaphragm 412 and passive diaphragm 413 (FIG. 6). In this example, the active diaphragm has a C-shape and the passive diaphragm has an oval shape. The oval has an outer perimeter OP with a complementary shape to the inner perimeter IP of the active diaphragm such that there is a partial superimposition and partial concentric arrangement along the inner perimeter IP. In other embodiments, the passive radiator could be sized and shaped so that it has an outer perimeter OP that fits within the active diaphragm's partial aperture (defined by periphery IP) but does not extend beyond the opening, as seen, for example, by referring to alternative outer perimeter OP' for passive diaphragm 413. In some embodiments, a partially bounding is where the active diaphragm bounds at least 10%, 20%, 30%, 40%, 50%, 60%, 70%, 80%, or 90% of the area of the passive diameter for a given, common horizontal plane.

From the principles disclosed herein, it will be appreciated that the disclosure provides substantial advantages, particularly for small audio appliances where space available inside the product is constrained, without compromising the length of voice coil, since the magnetic gap may be disposed along or within the larger, outer periphery of the active diaphragm 112.

The relative surface areas of the active diaphragm to the passive diaphragm can vary. In some embodiments, the ratio of area for the active diaphragm to area for the passive diaphragm can be from 0.5 to 2, or 0.7 to 1.5, or 0.8 to 1.25.

Referring now to the acoustic transducer 110 in FIG. 2, the magnets 116*a*, 116*b* are both annular or otherwise apertured. Magnet 116A is concentric to magnet 116B. The voice coil 114*a* of the drive member 114 is disposed in a space between the magnets 116A, 116B, and pistonically moves in that space, i.e., along an axis of excursion Z seen in FIG. 1B and FIG. 2. In contrast, the transducer of FIGS. 1-2 has a solid magnet 16B centered below diaphragm 12. By centering the passive diaphragm 113 over or in the opening of magnet 116A, the second major surface 113B of the passive diaphragm can be acoustically coupled with the second-major surface 112B of the active diaphragm 112 by the air mass exposed both second major surfaces, providing space for inducing vibrations in the passive diaphragm. As well, the passive diaphragm 113 may travel below the surface level of the magnet, for a greater range of pistonic movement. Such acoustic coupling, vibrational space and/or movement of the passive diaphragm 113 would be limited by a solid inner magnet like the one illustrated in FIG. 1B.

To allow for pressure equalization in transducer 110, a frame assembly 117 may include vents 32 disposed in selected elements of the frame assembly, acoustically coupling the air mass exposed to the second-major surface 112B of the active diaphragm 112 with the air mass exposed to the second major surface 113B of the passive diaphragm 113. Frame assembly 117 may be made of one or more elements that support the diaphragm and other parts of transducer 110.

Transducer 110 has a frame (or chassis) 117 and a suspension system including a surround 15 that suspends the respective diaphragms 112, 113 from the chassis 117. For example, the surround 15 can overlap with and be connected with a peripheral region of the respective diaphragm 112, 113. Transducer 110 can define a back region bounded in part by the major surfaces 112B, 113B of the diaphragms 112, 113. Similarly, transducer 110 can emit sound to a surrounding front region partially bounded by respective first major surface 112*a*, 113*a*. Some electronic devices acoustically couple such a micro-speaker with one or more open regions suitable for improving radiated sound, as in the nature of an acoustic chamber.

Looking more particularly at the surrounds for transducer 110, the active diaphragm 112 has adjacent outer surround 15A and inner surround 15B that respectively follow the outer and inner peripheries of the active diaphragm. Likewise, passive diaphragm 113 has a surround 15C that follows the outer periphery of the passive diaphragm. The passive diaphragms surround is concentrically adjacent the active diaphragm's surround 15B. However, surrounds 15B and 15C may be mechanically isolated from each other so that surround 15B does not directly drive surround 15C. This allows for the active diaphragm and passive diaphragm to be operated independently of the active diaphragm's drive element. In other words, in certain aspects, this disclosure contemplates a passive diaphragm that is suspended from a chassis or housing independently of the active diaphragm such that the passive diaphragm is configured to acoustically couple with pressure changes induced by excursions of the active diaphragm. As well, the passive diaphragm can be axially offset from the active diaphragm, e.g., along an axis of excursion defined by the active diaphragm as it reciprocates to and fro.

Figure 7:
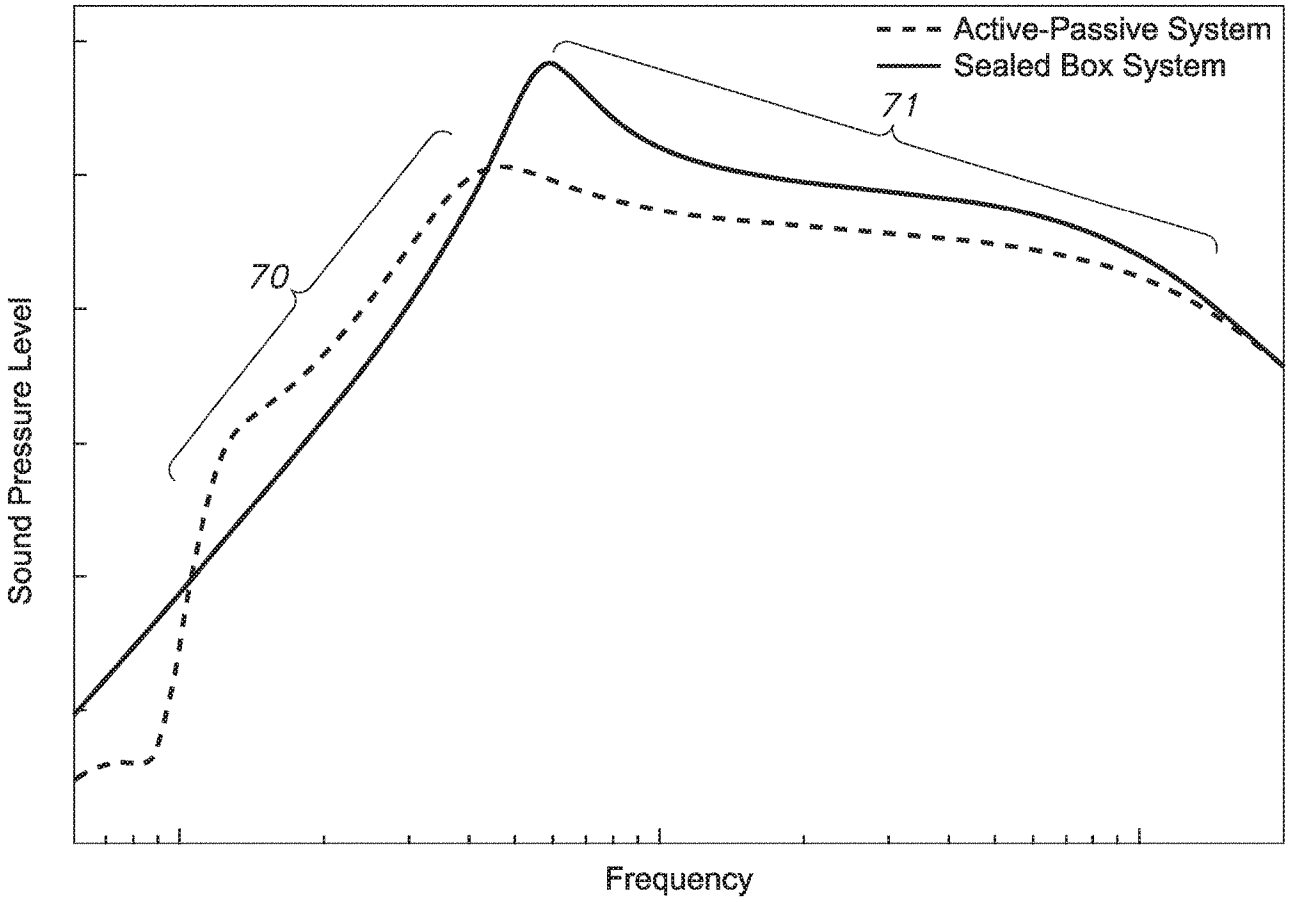
FIG. 7 is graph illustrating a modeling of expected acoustic output of an acoustic transducer embodying selected principles disclosed herein compared with a conventional acoustic transducer.

Acoustic transducers disclosed herein can include passive diaphragms that are configured to acoustically couple with the active diaphragm over a range of frequencies. In some embodiments, they acoustically couple at a frequency band of from about 100 Hz to about 400 Hz, for example, between about 70 Hz and about 500 Hz. FIG. 7 illustrates beneficial effects of such coupling in a graph showing a modeled frequency response curve for an enclosed active/passive diaphragm transducer like that shown in FIGS. 2-3 where the active diaphragm and integrated passive diaphragm of a given combined area are compared with a standard active diaphragm having the same combined area, but without a passive radiator.

In FIG. 7, the X-axis shows frequency in log scale and the Y-axis shows sound-pressure level. It can be seen from the modeled frequency response that the active-passive system outputs more energy from about 100 Hz to about 400 Hz, generally indicated by bracketed area 70, which is a desirable bass band, than a standard diaphragm. Both systems have the same or comparable back volume and same effective radiating area. This indicates that disclosed transducers having superimposed active and passive diaphragms can be tuned to provide improved outputs over selected frequency bands without substantially compromising output over other desired output bands (as indicated by bracketed area 71 in FIG. 7), and while not requiring as much, e.g., lateral, space as a traditional active-passive system arranged as depicted in FIG. 1A.

An acoustic transducer can be positioned in an acoustic module 1. The acoustic module 1 can be a stand-alone apparatus, as in the case of, for example, a traditional bookshelf speaker or a smart speaker. Alternatively, the acoustic module 1 can constitute a defined region within an encasement of a smaller, portable device, such as, for example, a smart phone. In still other alternative embodiments, the acoustic module can constitute a portion of a smart watch, an in-ear earphone, on on-ear headphone, or an over-the-ear headphone.

Although not shown in the Figures, a loudspeaker transducer and/or an acoustic housing can include other circuitry (e.g., application-specific integrated circuits (ASICs)) or electrical devices (e.g., capacitors, inductors, and/or amplifiers) to condition and/or drive electrical signals through the voice coil. Such circuitry can constitute a portion of a computing environment or audio appliance described herein.

Figure 8:
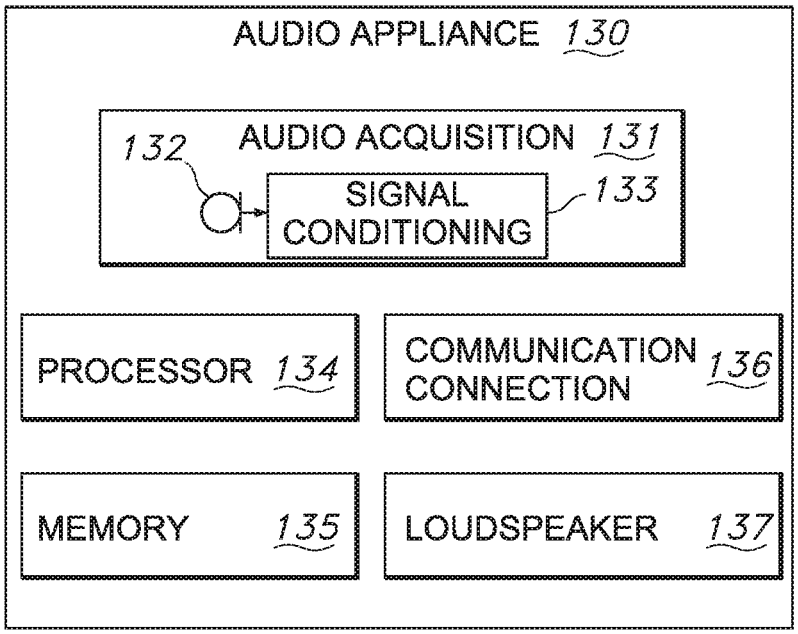
FIG. 8 illustrates a block diagram showing aspects of an audio appliance.

Referring now to FIG. 8, electronic devices incorporating disclosed electro-acoustic transducers are described by way of reference to a specific example of an audio appliance. Electronic devices represent but one possible class of computing environments which can incorporate a disclosed electro-acoustic transducer, as described herein. Nonetheless, electronic devices are succinctly described in relation to a particular audio appliance 130 to illustrate an example of a system incorporating and benefitting from disclosed electro-acoustic transducers.

As shown in FIG. 8, an audio appliance 130 or other electronic device can include, in its most basic form, a processor 134, a memory 135, and a loudspeaker or other electro-acoustic transducer 137, and associated circuitry (e.g., a signal bus, which is omitted from FIG. 16 for clarity). The memory 135 can store instructions that, when executed by the processor 134, cause the circuitry in the audio appliance 130 to drive the electro-acoustic transducer 137 to emit sound over a selected frequency bandwidth. In addition, the audio appliance 130 can have a ported acoustic chamber positioned adjacent the electro-acoustic transducer, as known in the art.

The audio appliance 130 schematically illustrated in FIG. 8 also includes a communication connection 136, as to establish communication with another computing environment. As well, the audio appliance 130 includes an audio acquisition module 131 having a microphone transducer 132 to convert incident sound to an electrical signal, together with a signal conditioning module 133 to condition (e.g., sample, filter, and/or otherwise condition) the electrical signal emitted by the microphone. In addition, the memory 135 can store other instructions that, when executed by the processor, cause the audio appliance 130 to perform any of a variety of tasks akin to a general computing environment, such as a distributed computing environment, a network connected computing environment, and a standalone computing environment.

An audio appliance can take the form of a portable media device suitable for use with a variety of accessory devices An accessory device can take the form of a wearable device, such as, for example, a smart-watch, an in-ear earbud, an on-ear earphone, and an over-the-ear earphone. An accessory device can include one or more electro-acoustic transducers as described herein.

IV. Other Exemplary Embodiments

Embodiments other than those described above in detail are contemplated based on the principles disclosed herein, together with any attendant changes in configurations of the respective apparatus described herein. For example, the principles described above in connection with any particular example can be combined with the principles described in connection with another example described herein.

Moreover, those of ordinary skill in the art will appreciate that the exemplary embodiments disclosed herein can be adapted to various configurations and/or uses without departing from the disclosed principles. Applying the principles disclosed herein, those of ordinary skill in the art will also appreciate that it is possible to provide a wide variety of acoustic transducers having active diaphragms with integrated passive diaphragms, and related systems. For example, although electrodynamic transducers having a magnet and voice coil are described in some detail above for illustrative purposes, presently disclosed principles related to acoustic transducers having active diaphragms with integrated passive diaphragms can be applied to a variety of transducer types and configurations. Several particular, but non-exclusive, examples of such transducers include flat-panel transducers (driven by an electrodynamic actuator, as above, or by way of an electrostatic actuator), multi-cell diaphragm transducers, and piezoelectric transducers. Further, those of ordinary skill in the art will appreciate that aspects of each particular embodiment described or shown in the accompanying drawings can be omitted altogether or implemented as a portion of a different embodiment without departing from related disclosed principles.

Directions and other relative references (e.g., up, down, top, bottom, left, right, rearward, forward, etc.) may be used to facilitate discussion of the drawings and principles herein, but are not intended to be limiting. For example, certain terms may be used such as "up," "down,", "upper," "lower," "horizontal," "vertical," "left," "right," and the like. Such terms are used, where applicable, to provide some clarity of description when dealing with relative relationships, particularly with respect to the illustrated embodiments. Such terms are not, however, intended to imply absolute relationships, positions, and/or orientations. For example, with respect to an object, an "upper" surface can become a "lower" surface simply by turning the object over. Nevertheless, it is still the same surface and the object remains the same. As used herein, "and/or" means "and" or "or", as well as "and" and "or." Moreover, all patent and non-patent literature cited herein is hereby incorporated by reference in its entirety for all purposes.

Accordingly, this detailed description shall not be construed in a limiting sense, and following a review of this disclosure, those of ordinary skill in the art will appreciate the wide variety of acoustic transducers, and related methods and systems that can be devised using the various concepts described herein.

The previous description of the disclosed embodiments is provided to enable any person skilled in the art to make or use the disclosed innovations. Various modifications to those embodiments will be readily apparent to those skilled in the art, and the generic principles defined herein may be applied to other embodiments without departing from the spirit or scope of this disclosure. Thus, the claimed inventions are not intended to be limited to the embodiments shown herein, but are to be accorded the full scope consistent with the language of the claims, wherein reference to an element in the singular, such as by use of the article "a" or "an" is not intended to mean "one and only one" unless specifically so stated, but rather "one or more". All structural and functional equivalents to the features and method acts of the various embodiments described throughout the disclosure that are known or later come to be known to those of ordinary skill in the art are intended to be encompassed by the features described and claimed herein. Moreover, nothing disclosed herein is intended to be dedicated to the public regardless of whether such disclosure is explicitly recited in the claims. No claim recitation is to be construed under the provisions of 35 USC 112(f) unless the recitation expressly recites the phrase "means for" or "step for".

Thus, in view of the many possible embodiments to which the disclosed principles can be applied, I reserve to the right to claim any and all combinations of features and technologies described herein as understood by a person of ordinary skill in the art, including, for example, all that comes within the scope and spirit of the following claims.

I currently claim:

1. An acoustic transducer, comprising:

a chassis;

an active diaphragm electromechanically coupled to an electric drive element and suspended from the chassis such that the active diaphragm can reciprocate along an axis of excursion;

a passive diaphragm suspended from the chassis independently of the active diaphragm such that the passive diaphragm is configured to acoustically couple with pressure changes induced by excursions of the active diaphragm; and an inner suspension member and an outer suspension member;

wherein the active diaphragm defines an outer perimeter and an inner perimeter, and the passive diaphragm defines an outer perimeter, wherein a projection of at least a portion of the outer perimeter of the passive diaphragm on a plane oriented orthogonally relative to the axis of excursion coincides with or is positioned within at least a region of a projection of the outer perimeter of the active diaphragm on the plane, wherein the inner suspension member couples the inner perimeter of the active diaphragm with the chassis and the outer suspension member couples the outer perimeter of the active diaphragm with the chassis.

2. The acoustic diaphragm of claim 1 wherein the inner perimeter of the active diaphragm defines a bounded area for the active diaphragm, wherein the passive diaphragm has an outer perimeter that axially, superimpositionally coincides on or within the inner perimeter of the bounded area.

3. The acoustic transducer of claim 2 wherein the bounded area is a fully bounded area defined by an aperture in the active diaphragm.

4. The acoustic transducer of claim 1 wherein the passive diaphragm is co-planar with the active diaphragm.

5. The acoustic transducer of claim 1 wherein the passive diaphragm is offset from the active diaphragm along the axis of excursion.

6. The acoustic transducer of claim 1 wherein the passive diaphragm is downwardly axially offset from the active diaphragm by not more than the peak-to-peak excursion of the passive diaphragm or the zero-to-peak excursion of the passive diaphragm during intended use.

7. The acoustic transducer of claim 1 wherein the passive diaphragm is configured to acoustically couple with the active diaphragm over a frequency range of about 100 Hz to about 400 Hz.

8. The acoustic transducer according to claim 1, wherein the electric drive element comprises a voice coil coupled with the active diaphragm, such that the active diaphragm and the coil are movable in correspondence with each other.

9. The acoustic transducer according to claim 8, wherein the electric drive element comprises a magnet so positioned adjacent the voice coil as to cause a magnetic field of the magnet to interact with a magnetic flux corresponding to an electrical current through the voice coil.

10. The acoustic transducer according to claim 9, wherein the magnet comprises an inner magnet and an outer magnet, wherein the voice coil is positioned between the inner magnet and the outer magnet and configured to move pistonically to and fro between a distal-most position and a proximal-most position relative to the inner magnet.

11. The acoustic transducer according to claim 10 wherein the inner magnet defines an opening and the passive diaphragm is disposed over the opening.

12. An acoustic-transducer module, comprising:

an acoustic transducer, comprising an active diaphragm electromechanically coupled to an electric drive element, and a passive diaphragm electromechanically independent of the electric drive element, the passive diaphragm configured to be driven through reciprocating excursions by pressure changes induced by movement of the active diaphragm;

the active diaphragm having an outer perimeter and an inner perimeter, the inner perimeter defining an aperture in the active diaphragm, wherein the passive diaphragm has an outer perimeter that, at least in part, axially, superimpostionally coincides on or within the outer perimeter of the active diaphragm;

a first chassis region and a second chassis region; and an inner suspension member movably coupling the inner perimeter of the active diaphragm with the first chassis region and an outer suspension member movably coupling the outer perimeter of the active diaphragm with the second chassis region.

13. The acoustic transducer of claim 12 wherein the outer perimeter of the passive diaphragm axially, superimpostionally coincides on or within the inner perimeter of the active diaphragm.

14. The acoustic transducer of claim 12 wherein the passive diaphragm is configured to acoustically couple with the active diaphragm within a frequency range of about 100 Hz to about 400 Hz.

15. The acoustic transducer module of claim 12 wherein the passive diaphragm is axially offset from the active diaphragm and the ratio of area for the active diaphragm to area for the passive diaphragm is from 0.5 to 2.

16. The acoustic transducer module of claim 12 wherein the active diaphragm has a ring-like configuration and the outer perimeter of the passive diaphragm is disposed adjacent the inner perimeter of the active diaphragm.

17. The acoustic module of claim 12 further comprising a housing defining a sealed acoustic enclosure, wherein air within the enclosure acoustically couples the passive diaphragm with the active diaphragm such that pressure changes in the enclosure induced by movement of the active diaphragm drives the passive diaphragm through corresponding excursions.

18. A method of making an acoustic-transducer, comprising:

providing an active diaphragm electromechanically coupled to an electric drive element and suspended from a chassis such that the active diaphragm can reciprocate along an axis of excursion, wherein the chassis defines a first chassis region and a second chassis region;

providing a passive diaphragm independent of the electrodynamic driver, the passive diaphragm configured to acoustically couple with the active diaphragm through pressure changes induced by reciprocation of the active diaphragm;

wherein the active diaphragm has an outer perimeter and an inner perimeter, and the passive diaphragm has an outer perimeter, wherein a projection of the outer perimeter of the passive diaphragm on a plane transverse to the axis of excursion is positioned on or within a projection of the outer perimeter of the active diaphragm on the plane;

with a first suspension member, suspending the inner perimeter of the active diaphragm from the first chassis region; and with a second suspension member, suspending the outer perimeter of the active diaphragm from the second chassis region.

19. The method of claim 18 wherein the inner perimeter of the active diaphragm defines a bounded area for the active diaphragm, the passive diaphragm having an outer perimeter that axially, superimpositionally coincides on or within the inner perimeter of the bounded area.

20. The method of claim 19 wherein the bounded area is a fully bounded area comprising an aperture in the active diaphragm.

* * * * *